US005529374A

United States Patent [19]

Wimberly, Jr.

[11] Patent Number: 5,529,374

[45] Date of Patent: Jun. 25, 1996

[54] DETACHABLE STEP STOOL FOR A BARBER'S CHAIR

[76] Inventor: Frank Wimberly, Jr., 148 Lovers La. Northeast, Milledgeville, Ga. 31061

[21] Appl. No.: 181,304

[22] Filed: Jan. 13, 1994

[51] Int. Cl.[6] ..... A47C 15/00

[52] U.S. Cl. ..... 297/240; 297/195.12

[58] Field of Search ..... 297/240, 241, 297/195.11, 195.13, 195.12

[56] References Cited

U.S. PATENT DOCUMENTS

| | | | |
|---|---|---|---|
| 415,307 | 11/1889 | Carrick | 297/240 X |
| 1,686,464 | 8/1927 | Perry | 297/241 |
| 2,572,874 | 10/1951 | MacKnight | 297/241 |
| 2,836,224 | 5/1958 | Hicks | 297/241 |
| 2,872,966 | 2/1959 | Chamness | 297/195.11 X |
| 4,863,217 | 9/1989 | Fountain | 297/241 |

FOREIGN PATENT DOCUMENTS

| | | | |
|---|---|---|---|
| 2558127 | 7/1985 | France | 297/195.11 |
| 1050589 | 6/1953 | Germany | 297/240 |
| 9779 | 11/1923 | Netherlands | 297/195.13 |

*Primary Examiner*—Peter M. Cuomo
*Assistant Examiner*—David E. Allred

[57] ABSTRACT

A detachable step stool for a barber's chair for providing seating and step-up for a barber or hair stylist to use while working on a client's hair, the detachable step stool for a barber's chair comprising a cantilevered swing arm rotationally connected to the vertical support post of a barber's chair, the swing arm having a padded stool seat removedly rotationally connected to its free end such that the stool seat may rotate and revolve around the barber's chair whereby a user may sit on the stool seat while styling the hair of a client seated in the barber's chair, and a step whereupon the user may stand to facilitate reaching high areas of a client's head.

1 Claim, 4 Drawing Sheets

DETACHABLE STEP STOOL FOR A BARBER'S CHAIR

BACKGROUND OF THE INVENTION

1. Field of the Invention

The present invention relates to barber and beauty shop chairs and more particularly pertains to detachable step stools for a barber's chair which may be used for providing seating and step-up for a barber or hair stylist to use while working on a client's hair.

2. Description of the Prior Art

The use of barber's chairs is known in the prior art. More specifically, barber's chairs heretofore devised and utilized for the purpose of providing seating for a client are known to consist basically of familiar, expected and obvious structural configurations, notwithstanding the myriad of designs encompassed by the crowded prior art which have been developed for the fulfillment of countless objectives and requirements.

The present invention is directed to improving devices for providing seating for a barber's client in a manner which is safe, secure, economical and aesthetically pleasing.

For example, U.S. Pat. No. 5,114,112 to Infanti discloses a detachable game stool assembly for detachably supporting a stool relative to a casino gaming machine comprising an elongated planar chair base with an upturned portion at one end received into an extruded rigid support member fixed to the base of a gaming machine. The invention disclosed does not revolve around the machine to provide access to all sides, nor does it provide step means to reach high areas of the machine.

U.S. Pat. No. 4,136,907 to Hermanns describes a barberchair having collecting devices connected to and in operative relationship with the backwall and sidewalls of the barberchair for collecting falling hair from a person seated in the chair.

U.S. Pat. No. 4,586,749 to Nakatani shows a barber/beauty chair that is hydraulically adjustable between the upright and reclined positions.

U.S. Pat. No. 4,711,486 to Fujiyama describes a barber and beauty parlor chair which also is hydraulically adjustable between the upright and reclined positions.

None of the three devices disclosed above provide a seat or step means for use by the operator The prior art also discloses a combined chair and stool apparatus as shown in U.S. Pat. No. 4,320,817 to Knoke et al. which consists of a pair of folding steps pivotally connected to leg means and pivot links such that the apparatus may be used as a folding chair or step stool. The invention disclosed does not suggest a way to revolvabilty attach the stool to a barber's chair for use of the barber or hair stylist while working.

In this respect, the detachable step stool for a barber's chair according to the present invention substantially departs from the conventional concepts and designs of the prior art, and in so doing provides an apparatus primarily developed for the purpose of providing seating and step-up for a barber or hair stylist to use while working on a client's hair.

Therefore, it can be appreciated that there exists a continuing need for new and improved detachable step stool for a barber's chair which can provide seating and step-up for a barber or hair stylist to use while working on a client's hair.

In this regard, the present invention substantially fulfills this need.

As illustrated by the background art, efforts are continuously being made in an attempt to provide seating for a barber's client. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of barber's chairs now present in the prior art, the present invention provides an improved detachable step stool for a barber's chair construction wherein the same can be utilized for providing seating and step-up for a barber or hair stylist to use while working. As such, the general purpose of the present invention, which will be described subsequently in greater detail, is to provide a new and improved detachable step stool for a barber's chair apparatus and method which has all the advantages of the prior art barber's chairs and none of the disadvantages.

The invention is defined by the appended claims with the specific embodiment shown in the attached drawings. For the purpose of summarizing the invention, the invention may be incorporated into a new and improved detachable step stool for a barber's chair for providing seating and step-up for a barber or hair stylist to use while working on a client's hair. The detachable step stool for a barber's chair comprises a first ring-shaped element formed of rigid structural material such as steel. The first ring-shaped element additionally has an integral elongated member extending radially therefrom such that a cantilevered swing arm is formed under the barber's chair seat. The swing arm has a second integral ring-shaped element radially formed on its free end, the second ring-shaped element sharing the plane of the first ring-shaped element. The second ring-shaped element also has an inside bushing surface. The detachable step stool for a barber's chair also includes a padded stool seat having a central downwardly projecting support post. The support post is removedly inserted into the second ring-shaped element such that the stool seat rotates and swings around the barber's chair whereby a user may sit on the stool while styling the hair of a client seated in the chair. The detachable step stool for a barber's chair additionally includes step means whereupon the user may stand to facilitate reaching high areas of a client's head. The step means also includes a pair of identical opposing support arms projecting from the sides of the block. The support arms have a horizontal top portion, an angled middle portion, and a horizontal bottom portion, the bottom portion being downwardly offset from the top portion by the angled middle portion. The top portion of the support arms is fixedly connected to the sides of the block. The bottom portion of the support arms has stepping pad means fixedly connected thereto whereupon the user may stand.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved detachable step stool for a barber's chair for providing seating and step-up for a barber or hair stylist to use while working on a client's hair, the detachable step stool for a barber's chair comprising a cantilevered swing arm rotationally connected to the vertical support post of a barber's chair, the swing arm extending radially from the support post to a point in space substantially beyond a circular clearance zone defined by the length and width of the barber's chair and protrusions, the swing arm also having a padded stool seat removedly and rotationally connected to its free end such that the stool seat may rotate and revolve around the barber's chair whereby a user may sit on the stool seat while styling the hair of a client seated in the barber's chair, and a step whereupon the user may stand to facilitate reaching high areas of a client's head, the step comprising: a horizontal cross member slidably connected to the swing arm such that the cross member can be moved longitudinally on the swing arm, the cross member extending equally from both sides of the swing arm, the cross member having stepping pads fixedly connected to both ends whereupon the user may stand.

It is another object of the present invention to provide a new and improved detachable step stool for a barber's chair which may be easily and efficiently manufactured and marketed.

It is a further object of the present invention to provide a new and improved detachable step stool for a barber's chair which is of a durable and reliable construction.

An even further object of the present invention is to provide a new and improved detachable step stool for a barber's chair which is susceptible of a low cost of manufacture with regard to both materials and labor, and which accordingly is then susceptible of low prices of sale to the consuming public, thereby making such detachable step stool for a barber's chair economically available to the buying public.

Still yet another object of the present invention is to provide a new and improved detachable step stool for a barber's chair which provides in the apparatuses and methods of the prior art some of the advantages thereof, while simultaneously overcoming some of the disadvantages normally associated therewith.

Still yet another object of the present invention is to provide a new and improved detachable step stool for a barber's chair which is unobtrusive, enabling a barber or hair stylist to work while standing without the stool being in the way.

Yet another object of the present invention is to provide a new and improved detachable step stool for a barber's chair which will help the user feel less tired at the end of the workday.

Even still another object of the present invention is to provide a new and improved detachable step stool for a barber's chair which will ease the task of styling the hair of a very tall person by providing a convenient step-up for the user to reach the top of a client's head without repeatedly pumping the chair up, then down again to reach the sides and back.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
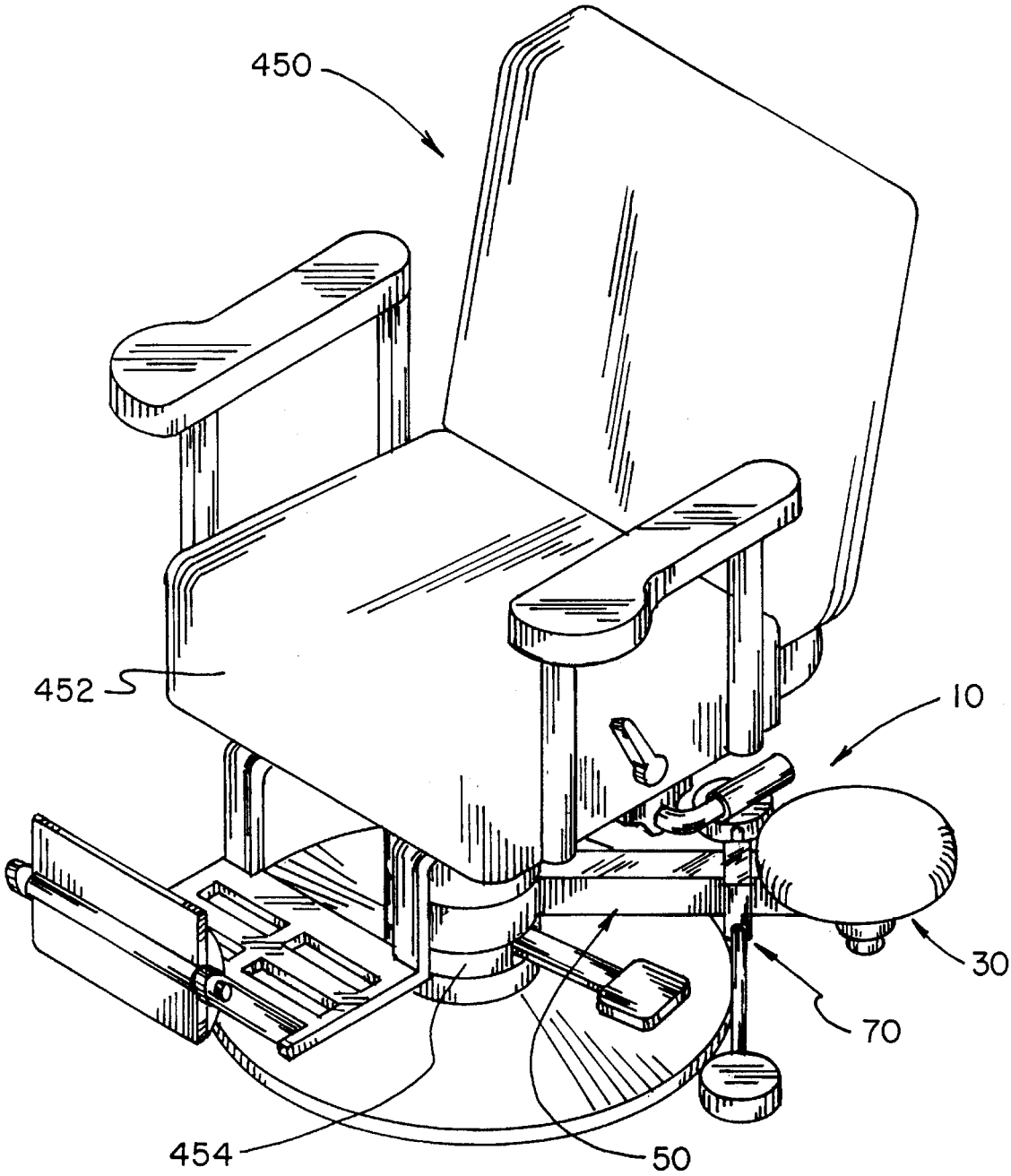
FIG. 1 is a perspective view of the detachable step stool for a barber's chair shown installed on a typical barber's chair.

With reference now to the drawings, and in particular to FIG. 1 thereof, a new and improved detachable step stool for a barber's chair embodying the principles and concepts of the present invention and generally designated by the reference numeral 10 will be described.

From an overview standpoint, the detachable step stool for a barber's chair is adapted for use for providing seating and step-up for a barber or hair stylist to use while working. See FIG. 1.

Figure 2:
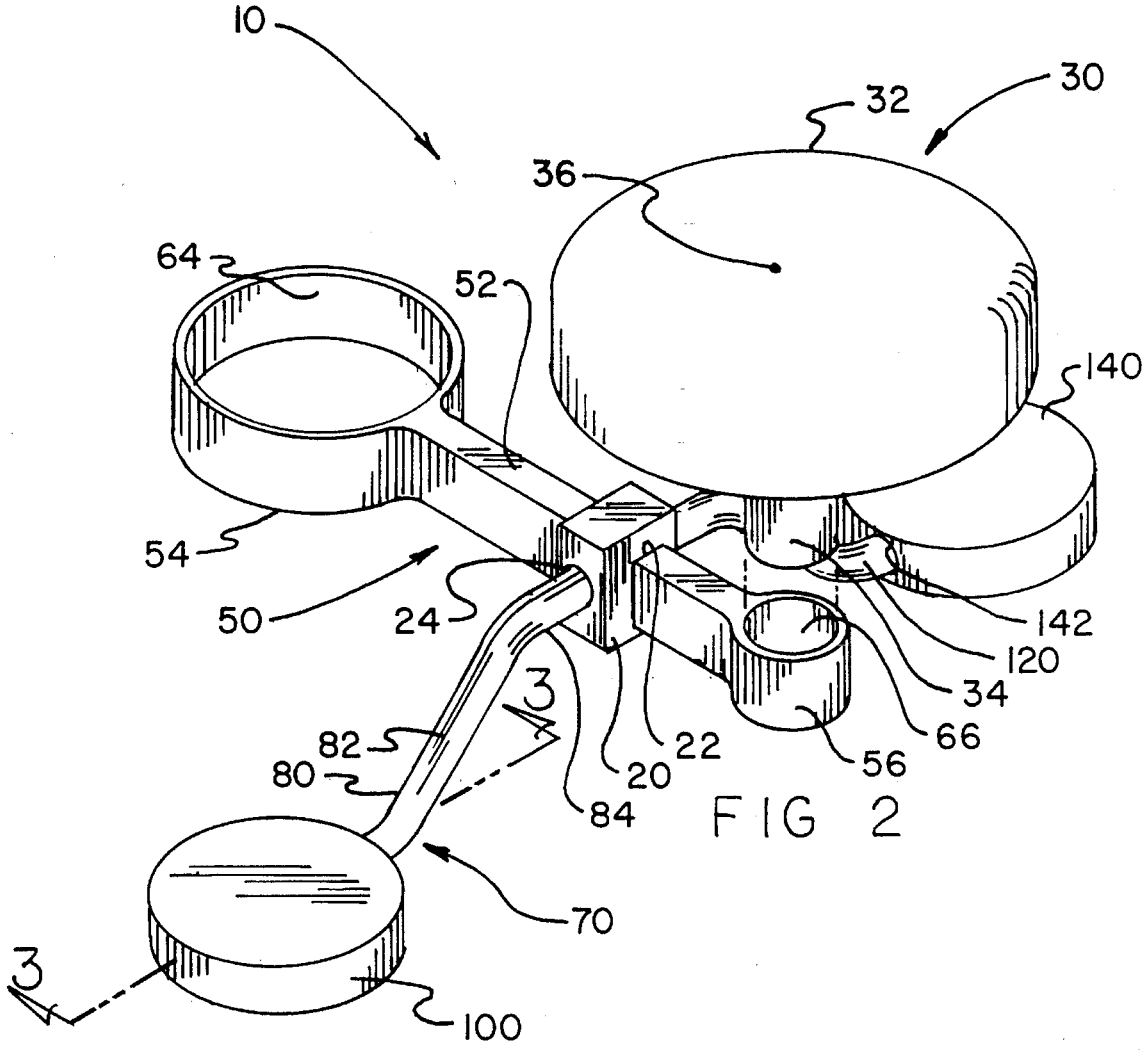
FIG. 2 is a perspective view of the present invention.
Figure 3:
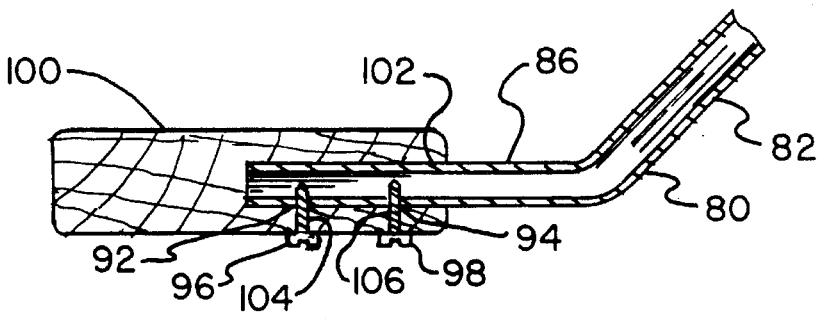
FIG. 3 is a sectional view of the invention of FIG. 2 taken along thee line 3—3.

With reference now to FIGS. 1, 2, and 3, more specifically, it will be noted that a detachable step stool for a barber's chair 10 provides seating and step-up for a barber or hair stylist for use while working on a client's hair. The detachable step stool for a barber's chair 10 comprises a first ring-shaped element 54 formed of rigid structural material such as steel.

The first ring-shaped element 54 is rotationally mounted on the vertical support post 454 of a barber's chair 450 below the seat 452 and has an inside bushing surface 64 to reduce frictional resistance whereby the ring-shaped element 54 may be rotated smoothly about the post 454. The first ring-shaped element 54 additionally has an integral elongated member 52 extending radially therefrom such that a cantilevered swing arm is formed under the barber's chair seat.

The swing arm 52 extends horizontally from the first ring-shaped element 54 to a point in space substantially beyond a circular clearance zone defined by the length and width of the barber's chair and protrusions. The swing arm 52 has a second integral ring-shaped element 56 radially formed on its free end, the second ring-shaped element 56 sharing the plane of the first ring-shaped element 54. The second ring-shaped element 56 also has an inside bushing surface 66.

The detachable step stool for a barber's chair 10 also includes a padded stool seat 30 having a central downwardly projecting support post 34. The support post 34 is removedly inserted into the second ring-shaped element 56 such that the stool seat 30 rotates and swings around the barber's chair 450 whereby a user may sit on the stool 30 while styling the hair of a client seated in the chair.

The detachable step stool for a barber's chair 10 additionally includes step means 70 whereupon the user may stand to facilitate reaching high areas of a client's head. The step means 70 comprises a block 20 formed of rigid structural material, such as steel, having surrounding sides, top, and bottom defining a longitudinal hole 22 therethrough. The longitudinal hole 22 has the same shape as the cross-sectional shape of the swing arm 52. The swing arm 52 extends through the longitudinal hole 22 in the block such that a user may slide the block 20 along the length of the swing arm 52.

The step means 70 also includes a pair of identical opposing support arms 80 and 120 projecting from the sides of the block 20. The support arms 80 and 120 are formed of rigid tubular material such as steel. The support arms 80 and 120 have a horizontal top portion 84, an angled middle portion 82, and a horizontal bottom portion 86, the bottom portion 86 being downwardly offset from the top portion 84 by the angled middle portion 82.

The top portion 84 of the support arms are fixedly connected to the sides of the block 24. The bottom portion 86 of the support arms has stepping pad means 100 and 140 fixedly connected thereto whereupon the user may stand.

Figure 4:
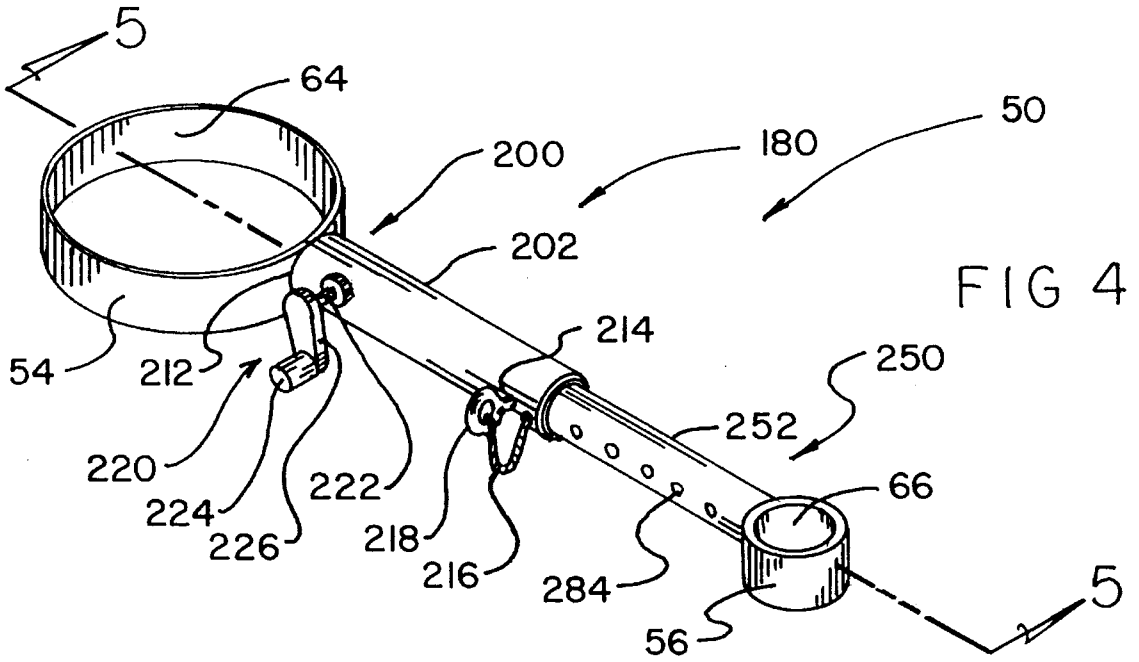
FIG. 4 is a perspective view of a first modification of the invention of FIG. 2 wherein the swing arm is telescopically adjustable.
Figure 5:
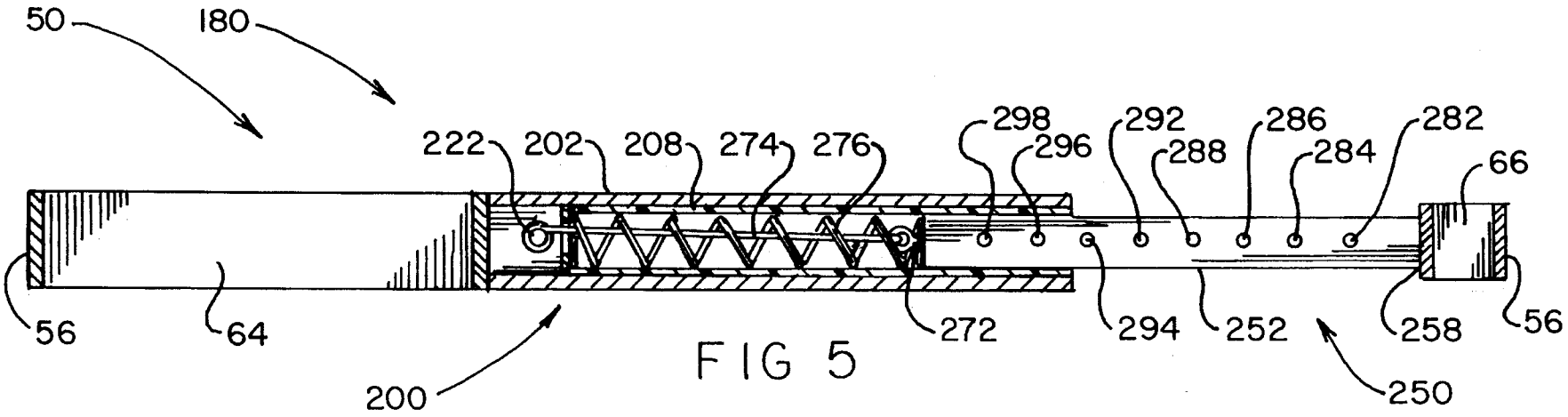
FIG. 5 is a sectional view of the invention of FIG. 4 taken along the line 5—5 showing the retractile cord and method of extensible biasing of the telescoping swing arm.

In a first modification to the preferred embodiment of the present invention 10, shown in FIGS. 4 and 5, the swing arm 50 includes adjustment means 180 whereby the horizontal distance between the stool seat 30 and the barber's chair 450 may be varied. The adjustment means 180 comprises a first tubular swing arm section 202 extending radially from the first ring-shaped element 54.

The first tubular swing arm section 202 is lined with a slippery material, such as polytetraflouroethylene, wherein a bearing surface 208 is formed. The first tubular swing arm section 202 also has a crank-operated reel therein 222. The first tubular swing arm section 202 additionally has a lateral hole 214 therethrough near its free end and a locking pin 218 with safety chain 216 means fixedly connected thereto so as to be cooperable with the lateral hole 214.

The adjustment means 180 of the first modification also includes a second tubular swing arm section 252 extending radially from the second ring-shaped element 56. The second tubular swing arm section 252 is disposed telescopically within the first tubular swing arm section 202. The second tubular swing arm section 252 has a plurality of longitudinally spaced apart lateral holes 282, 284,286, 288, 292,294, 296, and 298 therethrough, the holes 282, 284, 286, 288, 292, 294, 296, and 298 being cooperable with the lateral hole 214 and locking pin means 218 of the first tubular swing arm section 202 whereby the extended or retracted length of the swing arm 50 may be set at a variety of positions.

The second tubular swing arm section 252 also has a ring-eye 272 fixedly connected to its free end. The first modification adjustment means 180 additionally includes biasing means 276, such as a compression coil spring, longitudinally disposed within the first tubular swing arm section 202 in such a way as to urge the swing arm 50 to its fully extended state.

Figure 6:
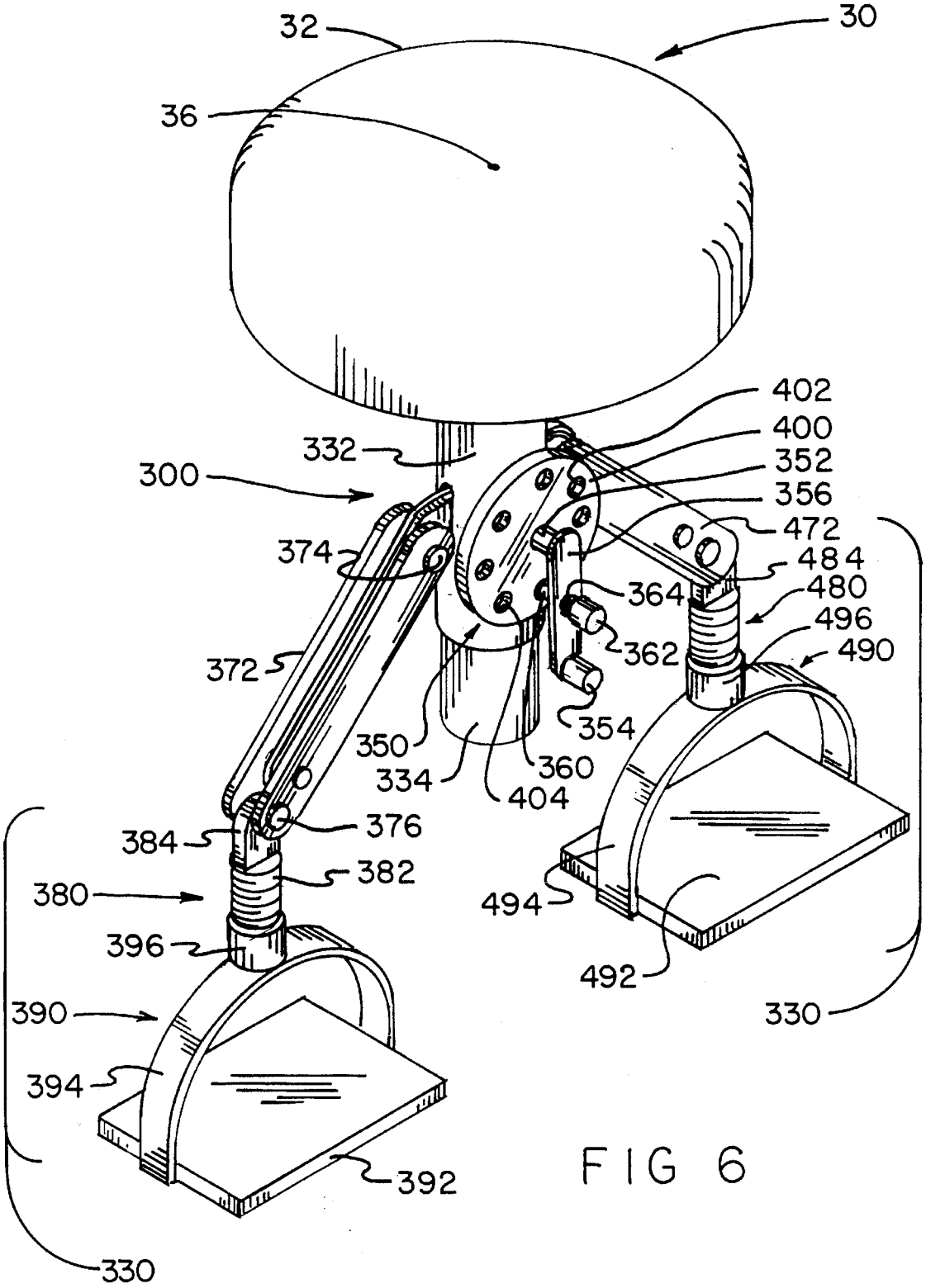
FIG. 6 is a perspective view of a second modification of the present invention illustrating the adjustable stirrups.

Further included in the adjustment means 180 is retractile cord means 274 fixedly connected on one end to the ring-eye 272 of the second tubular swing arm section 252. The retractile cord means 274 is retractably connected on the other end to the reel means 222 such that a user turning the crank 224 will overcome the extensible bias of the swing arm 50 thereby causing the swing arm to retract A second modification of the preferred embodiment of the detachable step stool for a barber's chair 10 is shown in FIG. 6, wherein the step means 70 is replaced by adjustable stirrups 330 whereby a user can adjust the amount of elevation off the floor to accommodate varying relative heights of barber and client. The adjustable stirrups 330 comprise a vertical tubular body 332 formed of rigid structural material, such as steel, having an open top wherein a socket (not shown) is formed wherein the downwardly projecting support post 34 of the padded stool seat 30 is removedly rotationally received.

The vertical tubular body 332 has at its bottom a coaxial support post 334 extending downwardly therefrom. The support post 334 is removedly rotationally inserted into the second ring-shaped element 56 such that the vertical tubular body 332 rotates and swings around the barber's chair 450 whereby a user may sit on the stool 30 while styling the hair of a client seated in the chair 450. The vertical tubular body 332 also has opposing vertically pivoting support arms 372 and 472 projecting laterally therefrom.

The vertical tubular body 332 additionally has adjustment means 350 therein whereby a user may pivot the arms 372 and 472 simultaneously upwardly or downwardly. The adjustment means 350 comprises a hand-operated crank having a crankshaft 352, a crank arm 356, and a crank handle 354. The crankshaft 352 is operably connected to the vertically pivoting support arms 372 and 472 such that revolving the crank handle 354 causes the free ends of the support arms 372 and 472 to ascend or descend.

The hand-operated crank also has a spring-loaded locking pin means 362 cooperating with a plurality of holes 402 and 404 arranged in a circular pattern around the crankshaft 352 whereby the position of the crank handle 354 may be set at a variety of positions corresponding to the holes 402 and 404 whereby the position of the vertically pivoting support arms 372 and 472 are set at a variety of elevations.

The adjustable stirrups 330 also include foot support means 390 and 490 for receiving a user's feet, the foot support means 390 and 490 comprise a pair of identical arcuate bail members 394 and 494 having downwardly extending legs and a pair of identical planar footpads 392 and 492 each fixedly connected between the ends of the downwardly extending legs of one of the bails 394 and 494. The adjustable stirrups 330 also include connector means 380 and 480 pivotally connected to the free ends 384 and 484 of each of the vertically pivoting support arms 372 and 472 and rotationally connected to the crown 396 and 496 of each arcuate bail member 394 and 494 such that the footpads 392 and 492 are suspended with freedom of yaw and swing movement from the ends of the vertically pivoting support arms 372 and 472 whereupon a user may stand.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A new and improved detachable step stool in combination with a barber's chair having a vertical support post and a seat, the detachable step stool providing seating and step-up for a barber or hair stylist to use while working on a client's hair, the detachable step stool for a barber's chair comprising:

a first ring-shaped element formed of rigid structural steel material, the first ring-shaped element being rotationally mounted on the vertical support post of the barber's chair below the seat, the first ring-shaped element also having an inside bushing surface to reduce frictional resistance whereby the ring-shaped element may be rotated smoothly about the post, the first ring-shaped element additionally having an integral elongated member extending radially therefrom such that a cantilevered swing arm is formed under the barber's chair, the swing arm extending horizontally from the first ring-shaped element to a point in space substantially beyond a circular clearance zone defined by the length and width of the barber's chair, the swing arm having a second integral ring-shaped element formed on its free end, the second ring-shaped element and the first ring-shaped element being in a common plane, the second ring-shaped element also having an inside bushing surface;

a padded stool seat having a central downwardly projecting support post, the support post being removably inserted into the second ring-shaped element such that the stool seat rotates and swings around the barber's chair whereby a user may sit on the stool seat while styling the hair of a client seated in the chair; and step means whereupon the user may stand to facilitate reaching high areas of a client's head, the step means comprising:

a block formed of rigid structural steel material having surrounding sides, top, and bottom defining a longitudinal hole therethrough, the longitudinal hole having the same shape as the cross-sectional shape of the swing arm, the swing arm extending through the longitudinal hole in the block such that a user may slide the block along the length of the swing arm;

a pair of identical opposing support arms projecting from the sides of the block, the support arms being formed of rigid tubular steel material, the support arms each having a horizontal top portion at a first distal end, an outwardly angled middle portion, and a horizontal bottom portion at a second distal end, the bottom portion being downwardly offset from the top portion by the angled middle portion, the first distal end of the support arm being fixedly connected to the sides of the block below the block top the second distal end of the support arms having stepping pad means fixedly connected thereto whereupon the user may stand.

* * * * *